United States Patent [19]

Giuffre et al.

[11] 4,020,235

[45] Apr. 26, 1977

[54] NOVEL COMPOSITE DIAPHRAGM MATERIAL

[75] Inventors: Luigi Giuffre, Milan, Italy; Vittorio De Nora, Nassau, Bahamas; Placido Spaziante, Milan, Italy

[73] Assignee: Oronzio de Nora Impianti Elettrochimici S.p.A., Milan, Italy

[22] Filed: May 7, 1975

[21] Appl. No.: 575,415

[30] Foreign Application Priority Data

Mar. 6, 1975 Italy ..... 20989/75

[52] U.S. Cl. ..... 428/443; 427/341; 204/296; 260/22 R; 260/79.3 R

[51] Int. Cl.[2] ..... C25B 13/06; C25B 13/08

[58] Field of Search ..... 204/296, 128, 252; 252/426, 428, 430; 428/443

[56] References Cited

UNITED STATES PATENTS

| | | | |
|---|---|---|---|
| 2,730,768 | 1/1956 | Clarke | 204/296 X |
| 3,256,250 | 6/1966 | Frilette | 260/79.3 R |
| 3,291,632 | 12/1966 | Nielsen et al. | 204/296 X |
| 3,821,127 | 6/1974 | Mizutani et al. | 204/296 X |
| 3,887,499 | 6/1975 | Hodgdon | 204/296 X |

*Primary Examiner*—Ralph S. Kendall
*Attorney, Agent, or Firm*—Hammond & Littell

[57] ABSTRACT

Novel composite material comprising a supporting matrix of inert fibers impregnated with a halogenated copolymer of divinyl benzene and styrene containing sulfonic acid groups copolymerized directly on the fiber material in the absence of a solvent which remains dimensionally stable under electrolysis conditions in diaphragm cells and the method of making them and the method of electrolyzing alkali metal halide solutions in a diaphragm cell equipped with a diaphragm made of said impregnated composite diaphragm material.

5 Claims, No Drawings

NOVEL COMPOSITE DIAPHRAGM MATERIAL

STATE OF THE ART

Chlorine has been produced commercially by electrolysis of alkali metal chloride solutions in diaphragm cells wherein the anodic and cathodic compartments are separated by a porous wall permeable to the electrolyte. The porous wall is intended to separate the chlorine gas formed at the anode from the hydrogen gas formed at the cathode and to maintain the pH difference existing between the anolyte and the catholyte in the cell.

In effect, two extremely diverse zones are formed during cell operation and in particular during the electrolysis of alkali metal chlorides, the reactions at the electrodes result as follows:

at the anode :$2Cl^- \rightarrow (Cl_2) + 2e^-$ at the cathode:$2H_2O + 2e^- \rightarrow (H_2) + 2OH^-$ In the catholyte, there is therefore an enrichment of $OH^-$ ions which, by electroosmosis, tend to migrate across the diaphragm towards the anode. The electrolyte in the anodic compartment usually has a pH between 3.5 and 5.5, whereas the electrolyte in the cathodic compartment has a pH above 12.0. It is, therefore, a function of the diaphragm to prevent such back-diffusion of the $OH^-$ ions which leads to the formation of chlorate in the electrolyte, the discharging of oxygen at the anode and to the consequent lowering of the faraday efficiency of the electrolytic process.

Asbestos, chrysotile in particular, through its particular properties such as its structure characterized by tubular fibers and capacity of being reasonably resistant both in an acidic environment and in a strongly alkaline environment has been and still is used, except in rare cases, in the making of such diaphragms. Usually the diaphragms are made of material, asbestos paper or of asbestos fibers deposited directly onto the cathodic structure by pulling an asbestos fiber slurry under vacuum through a foraminous cathode structure.

Conventional asbestos diaphragms have several disadvantages. In the first place, they have on average a life of 4 to 10 months and this contrasts greatly with the average life of the new dimensionally stable anodes which are coated having an average life that can be measured in years of service. This leads to the necessity of numerous replacements of the diaphragm before the anodes are changed with consequent loss of production as well as the cost of the replacement operation.

A second negative aspect of the known diaphragms is that in use they increase considerably in volume and by swelling up tend to completely fill the interelectrodic gap and thus approach the anodic surface. Due to this, they are subject to erosion by the anodic gas bubbles and this also leads to an increase in cell voltage.

A third negative aspect of asbestos diaphragms is functional and is due to the fact that the asbestos is without any substantial selective ionic properties for the same external factors such as the mobility of the various types of ions, the degree of concentration and the difference in pressure between the two compartments, asbestos diaphragms result equally permeable both to the anions and to the cations. On the contrary, the ideal diaphragm should be easily permeable to alkali metal cations and should prevent the migration of $OH^-$ anions from the catholyte to the anolyte.

Various proposals have been made recently to improve the mechanical stability properties of the asbestos diaphragms by means of impregnating the asbestos with soluble resins and subsequently sintering the resin to the asbestos by means of successive evaporation of the solvent and heat treatment. Another suggestion is the co-deposition of asbestos fibers and of thermoplastic resin powders or fibers on the cathodic structure followed by a sintering heat treatment.

The results of such techniques are not satisfactory. The capillary structure of the asbestos acts as a filter to the large polymeric molecules which makes the impregnation of the asbestos difficult and non-uniform. These techniques produce a porosity and a permeability which are not uniform and hardly reproducible. Although it is possible by these techniques, and by using polymeric loads which are high enough, to reduce the swelling of the asbestos diaphragm itself, it does not acquire any ionic selectively.

OBJECTS OF THE INVENTION

It is an object of the invention to provide novel composite diaphragm material comprising a matrix of fibrous inert material, preferably asbestos, impregnated with a copolymer of styrene and divinylbenzene suitable for forming dimensionally stable diaphragms in diaphragm cells and having ion-selective properties.

It is another object of the invention to provide a novel process for forming the said diaphragm material.

It is a further object of the invention to provide an improved method of electrolysis of alkali metal halides using a diaphragm made of the said composite material.

It is an additional object of the invention to provide improved diaphragm cells provided with a diaphragm made of said composite material.

These and other objects and advantages of the invention will become obvious from the following detailed description.

THE INVENTION

The novel composite material of the invention is comprised of asbestos or other inert fibrous material impregnated with a halogenated copolymer of styrene and divinyl benzene containing sulfonic acid groups copolymerized directly on the fibers in the absence of a solvent. The said fibers are uniformly coated with the copolymer and the introduction of the sulfonic acid groups in the copolymer results in the diaphragm being extremely stable under the operating conditions in diaphragm cells.

Diaphragms produced from the said composite material exhibit optimum chemical and mechanical stability, excellent wettability and a substantial ionic selectivity as the presence of highly negative groups in the copolymer hinders the backward migration or diffusion of the hydroxyl ions to the anodic chamber.

It has been found that the chlorinated copolymer of styrene and divinyl benzene has excellent chemical and mechanical resistance. By copolymerizing these two monomers, a highly reticulated structure is obtained which is very suitable for mechanically stabilizing the fibrous matrix of the diaphragm. Such a property would however not be useful in the known methods of impregnation or codeposition of asbestos with solutions or dusts of a preformed polymer and furthermore the copolymer is insoluble in common organic solvents.

The novel method of the invention for producing the asbestos material of the invention comprises impregnating the asbestos material with styrene, divinyl benzene and a polymerization initator, heating the impregnated asbestos material to effect copolymerization of the styrene and divinyl benzene, sulfonating the resulting asbestos with sulfur trioxide such as in solution in liquid sulfur dioxide or entrained in anhydrous nitrogen to introduce sulfonic acid groups in the styrene — divinyl benzene copolymer and halogenating of the resulting asbestos material to introduce halogen into the sulfonated divinyl benzene — styrene copolymer.

The copolymerization of the monomers directly onto the surface of the asbestos material which may be in the form of fibers or paper or any other convenient form in the absence of a solvent results in the formation of a close bond between the individual asbestos fibers and the copolymer. For this reason, diaphragms with properties of permeability, porosity, wettability and ionic selectivity which are reproducible and controllable by suitably modifying the methods of the formation of the diaphragm are obtained. Other inert natural or synthetic fibers can replace the asbestos material as long as they are resistant to the operating conditions of diaphragms cells.

The asbestos material is preferably impregnated with the monomers and the initator, such as an organic peroxide, by suspending the fibers in a solution thereof and then drying the fibers at temperatures below the polymerization temperature, such as at room temperature under vacuum. The impregnated asbestos material is then heated to a temperature to effect copolymerization of the monomers.

The asbestos material is preferably throughly washed after copolymerization with an organic solvent such as benzene to remove any residual styrene monomers and lower homopolymers of styrene which are non-latticed and successively throughly dried. The copolymer-asbestos material is then sulfonated by reacting it with sulfur trioxide in liquid sulfur dioxide as solvent at a temperature below the boiling point of sulfur dioxide which is about −10° C and preferably at −10° to −30° C. The stabilization of the $—SO_3H$ groups introduced into the copolymer is effected by adding a small amount of water to the system. Finally, after removal of the sulfur dioxide by evaporation, the product is thoroughly washed in running water until the effluent water is substantially neutral.

According to an alternative method, sulfonation may be effected by passing a flow of anhydrous nitrogen containing $SO_3$ through the material. Stabilization of the sulfonic group in the copolymer is effected by passing a flow of nitrogen saturated with water vapor and washing the product in water until neutrality is reached in the effluent.

The halogenation of the sulfonated copolymer-asbestos material is effected in any suitable manner with a halogen, such as fluorine, bromine or chlorine. Preferably, chlorine gas is bubbled through the material in the presence of water and catalytic amounts of ferric chloride catalyst to stabilize the copolymer.

In a preferred embodiment of the invention, the asbestos material is suspended in a benzene solution containing styrene, divinyl benzene and benzoyl peroxide, the asbestos material is dried under vacuum at room temperature and heated to 80° to 100° C to effect copolymerization, washed with benzene, the copolymer-asbestos material is sulfonated with $SO_3$ in liquid sulfur dioxide at about −10° C and is then washed with water and the resulting material is suspended in water containing ferric chloride while bubbling chlorine gas therethrough.

The final product consisting of the copolymer and the supporting inert fibrous material may contain from about 2% to about 98% of the total weight of copolymer. When the copolymer is about 75 to 98%, by weight, of the total composition, the material may be formed, according to known manufacturing techniques, such as hot lamination, sintering etc., into a substantially impervious or microporous permionic membrane. When the copolymer is 2 to 75% by weight of the total composition, the diaphragm has the porosity characteristics of regular asbestos diaphragms.

The copolymer may contain 95 to 75 moles percent of styrene and 5 to 25 mole percent of divinylbenzene and preferably the molar ratio of styrene to divinylbenzene should be between 9 to 1 and 8.5 to 1.5. The amount of initiator may be 0.5 to 2% of the molar weight of the monomers. The degree of sulfonation of the copolymer may vary from 3 to 20% of the number of latticed styrene rings, but is preferably about 10% and the degree of halogenation may vary from 3 to 100%, preferably about 10%.

One of the greatest advantages of the process is that it can be used to treat the asbestos fibers prior to use as a diaphragm making it possible for them to be processed for the preparation of the diaphragm by the traditional technique of depositing the desired thickness of asbestos by pulling under a vacuum a liquid suspension of the treated fibers through the foraminous structure of the cathode or the preformed asbestos diaphragm can be treated according to the method of the invention directly on the cathode of a conventional cell.

In comparison with conventional asbestos diaphragms, the diaphragms of the invention show a number of substantial advantages namely a much longer life use. Tests for determining the average life in conventional cells for the production of chlorine-caustic give a statistical forecast which at present is already on the order of two years. The new diaphragms prove to be more resistant to mechanical abrasion and are easily handled. The increase in the thickness of the diaphragm during operation in the cells is limited to about 10 – 15% of the original dry thickness.

Lower cell voltage for the same interelectrodic distance results because of the reduced swelling of the diaphragm and its superior abrasion resistance to the anodic gas and consequent further reduction of the cell voltage and of the electric energy consumption. Better faraday efficiency of the electrolytic process and reduction of chlorate concentration in the electrolyte is obtained as well as higher caustic soda concentration in the catholyte.

Diaphragms prepared according to the invention have been tested with remarkable success in experimental diaphragm cells for the electrolysis of sodium chloride. In particular, a cell voltage of 100 – 300 mv lower than the voltage found in the case of conventional asbestos diaphragms having a dry thickness which is equal to that of the new type of diaphragm has been found. The faraday efficiency shows an improvement of about 2 – 6% and the concentration of the caustic in the cathodic effluent is consistantly higher than that found when traditional diaphragms are used.

In the following examples there are described several preferred embodiments to illustrate the invention. However, it is to be understood that the invention is not intended to be limited to the specific embodiments.

EXAMPLE 1

50 g of 3 T grade asbestos fibers (QAMA classification) were suspended in a solution of 20 g of styrene, 1 g of divinyl benzene and 0.5 g of benzoyl peroxide in 100 ml of benzene in a 500 ml flask and after agitating the mixture to obtain a uniform suspension, the benzene was evaporated at 20° C under reduced pressure. After the benzene had been removed, the resulting fiber mixture was heated at 80° C for 6 hours to effect polymerization of styrene and divinyl benzene. The asbestos fibers were then washed with benzene at 50° C to remove any possible styrene homopolymers and were then dried. The dried fibers were 20% by weight heavier than the starting dried asbestos fibers.

The treated dried fibers were placed under a dry nitrogen atmosphere in a 500 ml glass reactor provided with a magnetic stirrer and a 200 ml dripper, both of which were provided with a cooling sleeve through which dry ice-cooled acetone was circulated. 150 ml of liquid $SO_2$ condensed at −30° C were added to the reactor and 100 ml of liquid $SO_2$ were condensed inthe dripper and 8 ml of liquid $SO_3$ were added thereto in the dripper. The solution of sulfur trioxide in sulfur dioxide was added dropwise over 30 minutes to the mixture of treated asbestos fibers in liquid sulfur dioxide in the reactor and the temperature was raised to −10° C for 20 minutes. Then, 5 ml of water were added to the reactor to stabilize the sulfonic acid groups introduced into the polymer and the liquid sulfur dioxide was evaporatd off. The fibers were washed with water until the wash waters were neutral and were then suspended in the same reactor in 200 ml of water containing 0.6 g of ferric chloride as catalyst. Chlorine gas was then bubbled through the suspension for 30 minutes during which the temperature rose from 20° to 70° C. The fibers were removed by filtration, washed with dilute hydrochloric acid and then with water until the wash waters were neutral.

The resulting asbestos fibers were then used to form a diaphragm in a experimental diaphragm cell and a sodium chloride solution was electrolyzed therein. The results were compared with a conventional asbestos diaphragm having the same dry thickness and the cell voltage was 100 to 250 mv lower and the faraday efficiency was improved by 2 to 6% with the treated diaphragm of the invention. Moreover, the concentration of sodium hydroxide in the cathodic effluent was higher with the diaphragm of the invention.

EXAMPLE 2

The procedure of Example 1 was repeated except that the quantities of styrene and divinyl benzene were doubled and chloroform was the solvent. The treated asbestos fibers had a weight increase of 50% and were excellent for the formation of diaphragms.

EXAMPLE 3

A sheet of asbestos paper measuring 20 cm by 2 cm and weighing 21 g was immersed in a solution of 40 g of styrene, 4 g of divinyl benzene and 0.4 g of benzoyl peroxide in 40 ml of benzene for 15 minutes and the sheet was then removed. The benzene impregnated therein was evaporated by holding the sheet under reduced pressure at 20° C and the asbestos sheet was then heated at 80° C for 2 ½ hours to effect polymerization of styrene and divinyl benzene. The sheet was then throughly washed with benzene to remove any homopolymers of styrene and was then dried to obtain asbestos paper with a weight increase of 80%.

The treated asbestos paper was then sulfonated in the same manner as in Example 1 except that agitation was effected by bubbling dry nitrogen through the solution. The asbestos paper was then throughly washed and then was placed in a liter of water containing 5 g of ferric chloride as catalyst at 70° C. Gaseous chlorine was bubbled through the immersed paper for 5 minutes and the asbestos paper was then washed with dilute hydrochloric acid and water until the wash waters were neutral. The resulting asbestos paper was then used successfully as a diaphragm in the cell of Example 1.

EXAMPLE 4

A sheet of asbestos paper weighing 46 g and measuring 20 cm × 20 cm was treated by the procedure of Example 3 and the paper showed a 45% weight increase after polymerization.

EXAMPLE 5

A slurry of 3 T grade asbestos fibers suspended in an aqueous solution containing 130 g per liter of sodium hydroxide and 195 g per liter of sodium chloride was used to deposit a diaphragm on an iron cathode screen under vacuum and the diaphragm was washed with water and then was dried. The diaphragm coated cathode was throughly soaked in a solution of 50% by weight of styrene, 5% by weight of divinyl benzene and 1% by weight of benzoyl peroxide in benzene and the cathode was held at 20° C under vacuum to evaporate all the benzene. The diaphragm coated cathode was heated at 80° C for 2 hours and was then washed with benzene to remove any styrene homopolymers and was dried.

The diaphragm of the cathode was flushed for 5 minutes with anhydrous nitrogen gas containing sulfur trioxide and then with nitrogen saturated with water to destroy any excess sulfur trioxide and to stabilize the sulfonic acid group. The diaphragm was throughly washed with water and the coated cathode was immersed in water at 70° C containing a small amount of ferric chloride as catalyst. Gaseous chlorine was then bubbled through the diaphragm for 5 minutes and the diaphragm on the cathode was washed with dilute hydrochloric acid and then with water until the wash waters were neutral.

The diaphragm-coated cathode was then assembled back into a test cell and a sodium chloride solution was electrolyzed therein. The results compared favorably with the results obtained with a conventional asbestos diaphragm having the same dry thickness. In particular, the cell voltage was lower and the faraday efficiency was improved by 4%.

Various modifications of the products and processes of the invention may be made without departing from the spirit or scope thereof. In particular, while the invention has been illustrated using asbestos as a most suitable supporting or strengthening fibrous matrix, other fibrous materials which are chemically and mechanically resistant to the conditions existing within the electrolysis cell and which are compactable into a thin resistant mat are equally suited to the scope of the invention. It should be understood that the invention is intended to be limited only as defined in the appended claims.

We claim:

1. A composition comprising an inert fibrous material impregnated with a copolymer of styrene and divinyl benzene copolymerized directly on the material in the absence of a solvent and then sulfonated and halogenated.

2. The composition of claim 1 wherein the fibrous material is asbestos.

3. The composition of claim 1 wherein the halogen is chlorine.

4. The composition of claim 1 wherein the amount of copolymer is from 2 to 98% by weight of the composition.

5. A composition of claim 1 the inert fibrous material is impregnated with styrene, divinyl benzene and a polymerization initator, the impregnated fibrous material is heated to effect copolymerization of the styrene and divinyl benzene, the resulting fibrous material is sulfonated with sulfur trioxide to introduce sulfonic acid groups in the styrene — divinyl benzene copolymer and the resulting fibrous material is halogenated to introduce halogen into the sulfonated divinyl benzene-styrene copolymer.

* * * * *